US008646877B2

(12) United States Patent
Thompson et al.

(10) Patent No.: US 8,646,877 B2
(45) Date of Patent: Feb. 11, 2014

(54) PRE-TREATMENT METHODS, APPARATUS, AND SYSTEMS FOR CONTACT LEVELING RADIATION CURABLE GEL INKS

(75) Inventors: Michael D. Thompson, Rochester, NY (US); Fusheng Xu, Webster, NY (US); Anthony S. Condello, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 13/249,169

(22) Filed: Sep. 29, 2011

(65) Prior Publication Data

US 2013/0083129 A1 Apr. 4, 2013

(51) Int. Cl.
*B41J 2/14* (2006.01)
*B41J 2/16* (2006.01)

(52) U.S. Cl.
USPC ..... 347/52; 347/102

(58) Field of Classification Search
USPC ..... 347/52, 102, 51
See application file for complete search history.

(56) References Cited

U.S. PATENT DOCUMENTS

| | | | | |
|---|---|---|---|---|
| 6,472,056 | B1 * | 10/2002 | Rea et al. | 428/216 |
| 6,561,640 | B1 * | 5/2003 | Young | 347/102 |
| 7,073,901 | B2 * | 7/2006 | Mills et al. | 347/102 |
| 7,140,711 | B2 * | 11/2006 | Nerad et al. | 347/19 |
| 2006/0132570 | A1 * | 6/2006 | Odell et al. | 347/102 |
| 2006/0290760 | A1 * | 12/2006 | German et al. | 347/102 |
| 2007/0120930 | A1 * | 5/2007 | Domoto et al. | 347/102 |
| 2008/0122914 | A1 * | 5/2008 | Toma et al. | 347/100 |
| 2010/0177151 | A1 * | 7/2010 | Thompson et al. | 347/102 |

OTHER PUBLICATIONS

Heering, Wolfgang, "UV Sources—Basics, Properties and Applications", Lichttechnisches Intitut, University of Karlsruhe, Kaiserstrasse 12, D-76131 Karlsruhe, Germany, pp. 1, 11, (2004).*
Bryan J. Roof et al.; Methods of Forming Images on Substrates With Ink Partial-Curing and Contact Leveling and Apparatuses Useful in Forming Images on Substrates; U.S. Appl. No. 12/881,715, filed Sep. 14, 2010.
Bryan J. Roof et al.; Methods of Adjusting Gloss of Images Locally on Substrates Using Ink Partial-Curing and Contact Leveling and Apparatuses Useful in Forming Images on Substrates; U.S. Appl. No. 12/881,753, filed Sep. 14, 2010.
Bryan J. Roof et al.; Methods of Adjusting Gloss of Images on Substrates Using Ink Partial-Curing and Contact Leveling and Apparatuses Useful in Forming Images on Substrates; U.S. Appl. No. 12/881,802, filed Sep. 14, 2010.
Edward B. Caruthers et al.; Methods of Treating Ink on Porous Substrates Using Partial Curing and Apparatuses Useful in Treating Ink on Porous Substrates; U.S. Appl. No. 12/881,837, filed Sep. 14, 2010.

* cited by examiner

*Primary Examiner* — Matthew Luu
*Assistant Examiner* — Michael Konczal
(74) *Attorney, Agent, or Firm* — Ronald E. Prass, Jr.; Prass LLP

(57) ABSTRACT

A radiation curable gel ink printing system is provided that includes a radiation source configured to emit UV light having short wavelength components. The disclosed systems and methods transport a substrate having radiation curable gel ink deposited thereon to the radiation source to expose the ink to the radiation source. The exposure at the radiation source may be continuous or pulsed. The radiation source may be configured a distance away from the radiation curable gel ink deposited on the substrate. The radiation source pre-treats the radiation curable gel ink before spreading the radiation curable gel ink at a contact-leveling nip at which a contact member applies pressure to the partially cured radiation curable gel ink against the substrate. The radiation curable gel ink is preferentially cured to allow spreading of the radiation curable ink by the contact member while limiting offset of the ink onto the contact member.

16 Claims, 8 Drawing Sheets

PRE-TREATMENT METHODS, APPARATUS, AND SYSTEMS FOR CONTACT LEVELING RADIATION CURABLE GEL INKS

RELATED APPLICATIONS

This disclosure relates to the applications entitled "METHODS OF FORMING IMAGES ON SUBSTRATES WITH INK PARTIAL-CURING AND CONTACT LEVELING AND APPARATUSES USEFUL IN FORMING IMAGES ON SUBSTRATES" Ser. No. 12/881,715; "METHODS OF ADJUSTING GLOSS OF IMAGES ON SUBSTRATES USING INK PARTIAL-CURING AND CONTACT LEVELING AND APPARATUSES USEFUL IN FORMING IMAGES ON SUBSTRATES" Ser. No. 12/881,802; "METHODS OF TREATING INK ON POROUS SUBSTRATES USING PARTIAL CURING AND APPARATUSES USEFUL IN TREATING INK ON POROUS SUBSTRATES" Ser. No. 12/881,837, and "METHODS OF ADJUSTING GLOSS OF IMAGES LOCALLY ON SUBSTRATES USING INK PARTIAL-CURING AND CONTACT LEVELING AND APPARATUSES USEFUL IN FORMING IMAGES ON SUBSTRATES" Ser. No. 12/881,753, the disclosures of which are incorporated herein by reference in their entirety.

FIELD OF DISCLOSURE

This disclosure relates to spreading radiation curable gel ink at a contact-leveling nip. In particular, the disclosure relates to methods, apparatus, and systems for applying a radiation pre-treatment to radiation curable gel ink deposited on a substrate before the ink is processed at a contact-leveling nip.

BACKGROUND

Radiation curable phase change gel inks may be used to form images on substrates in printing. The ink may be exposed to radiation to cure the ink. Exemplary radiation-curing techniques include, for example, curing using ultraviolet (UV) light, for example having a wavelength of 200-400 nm or more rarely visible light, optionally in the presence of photoinitiators and/or sensitizers, curing using thermal curing, in the presence or absence of high-temperature thermal initiators (and which may be largely inactive at the jetting temperature), and appropriate combinations thereof.

During this exposure, photoinitiator substances contained in the ink may be irradiated with the UV radiation, and the incident flux converts monomers in the ink into a cross-linked polymer matrix, resulting in a hard and durable mark on the substrate. For some applications, it may be desirable to spread or level the ink on the substrate before curing. Leveling can produce more-uniform image gloss and mask missing jets of print heads. Additionally, certain print applications, such as packaging, may benefit from having thin ink layers of relatively-constant thickness in prints.

UV curable phase change inks may have a gel-like consistency at ambient temperature. As UV gel inks are heated from about ambient temperature to an elevated temperature, they undergo a phase change to a low-viscosity liquid. These inks may be heated until they change to a liquid and then applied to a substrate. Once the ink contacts the substrate, the ink cools and changes phase from the liquid phase back to its more viscous, gel consistency.

UV curable gel ink images such as those formed by inkjet printers configured for radiation curable gel ink printing tend to display a non-uniform gloss. For example, such images may exhibit a "corduroy effect", and/or may suffer from common inkjet image quality streaking caused by missing ink jets. To overcome such deficiencies, the ink may be thermally re-flowed before curing. While this technique may mask missing jets, resulting images may suffer from instability on smooth substrates and/or bleed-through or showthrough on porous substrates. Accordingly, it has been found that contact-leveling gel ink on a substrate by contacting a gel ink image with a contact member such as a leveling roll effectively spreads the ink before final cure to mask missing jets and/or improve gloss uniformity.

SUMMARY

Contact-leveling may be used to spread or flatten a layer of radiation curable gel ink, such as UV curable gel ink, deposited onto a substrate. However, at ambient temperature, uncured UV curable gel inks have very little cohesive strength, and have a good affinity to many types of materials. Consequently, conventional methods and devices used for flattening a layer of other ink types, such as a conventional fixing roll that may be used in xerography, are unsuitable for leveling gel inks prior to curing, because gel inks will tend to split and offset onto the device used to try to flatten it.

It has been determined that radiation curable phase change ink such as UV curable gel ink deposited onto a substrate may be exposed to radiation to partially-cure the ink before spreading the ink at a contact-leveling nip. This enables the ink to be leveled without offset, or with substantially no offset, of the ink onto components of the contact-leveling apparatus that defines the contact-leveling nip.

In an embodiment, methods may include exposing radiation curable gel ink on a substrate to pre-treatment radiation from a first radiation source, and spreading the pre-treated gel ink by contact-leveling. The radiation curable ink may be UV curable, and the radiation source may be configured to emit UV light.

For example, methods may include irradiating the gel ink with UV light emitted from a mercury lamp. Alternatively, a Xenon lamp may be used. In another embodiment, a filtered lamp or LED may be implemented as a radiation source.

Methods may include depositing the gel ink onto a substrate before exposing the ink to radiation. For example, an inkjet print head may be used to jet ink line(s) onto a substrate. The ink lines may be configured to form an ink image, and may have an outer surface layer, and an inner layer. During a pre-treatment period, after ink deposition and before contact-leveling or spreading, the ink may be exposed to pre-treatment radiation.

The pre-treatment radiation may comprise short wavelength UV light. For example, pre-treatment radiation may comprise a UVB component in a range of about 280 nanometers (nm) to about 320 (nm). A light source type, e.g., doped, undoped, mercury, Xenon, or LED, may be used to apply radiation having a desired amount of short wavelength content necessary for preferentially curing the ink so that a surface layer of the ink is cured to an extent that prevents offset onto components of a contact-leveling apparatus, while an inner layer of the ink is cured only insofar as the ink is spreadable by contact-leveling. An amount of energy output by the radiation device may be controlled by adjusting a gap distance, or distance between ink on a substrate and the pre-treatment radiation source. Further, in an embodiment, the radiation source may be pulsed to accommodate control of radiation dosing during the pre-treatment period. Frequency of pulsing may be adjusted as needed to accommodate effective preferential curing during pre-treatment for subsequent contact-leveling.

In an embodiment, methods may include exposing radiation curable gel ink to radiation after pre-treatment, and after contact-leveling. For example, the ink may be irradiated after spreading for a final cure of the ink. A second radiation source may be configured to apply broad spectrum radiation to the ink, depending on the requirements of the ink. The radiation emitted by the second radiation source may be such that it penetrates deeper into the ink to produce a final cure. The energy provided during pre-treatment may reduce the energy required to cure the ink image after spreading.

In an embodiment, apparatus may include a radiation source. The radiation source may be configured to emit, e.g., UV light, to pre-treat radiation curable gel ink deposited onto a substrate before the gel ink is spread on the substrate by a contact-leveling apparatus. The radiation source may be configured to emit short wavelength UV light to accommodate preferential curing of the ink. For example, an outer surface layer of the ink may be cured to so that the ink will not offset onto a surface of a contact-leveling member, such as a belt or drum, during spreading. An inner layer of the ink may be cured so that the ink remains at a viscosity that allows the ink to spread under pressure applied by the contact-leveling member.

In an embodiment, a pre-treatment radiation source may be configured to emit UV light for pre-treating gel ink on a substrate wherein the UV light includes a UVB component having a wavelength in a range of about 280 nm to about 320 nm. The UV light may have a UVC component of about 280 nm or less. A UV light emission having such short wavelength characteristics is more effective for preferential curing of the ink on the substrate than a UV light emission having longer wavelength radiation. For example, longer wavelength UV light having a UVA component of about 320 nm to about 390 nm, and a UW component of about 395 nm to about 445 nm is more effective for depth curing coatings and inks. In an embodiment, an apparatus may include a radiation source configured to expose a short wavelength pre-treated gel ink image to longer wavelength radiation after contact-leveling or spread the gel ink image.

In an embodiment, a radiation source suitable for emitting short wave UV light may include an undoped mercury lamp. For example, an undoped mercury lamp having an envelope comprised of clear fused quartz may provide enhanced short wavelength UV content in contrast with the higher UVA content in a range of about 320 nm to about 390 nm typically emitted by iron-doped mercury lamps. In another embodiment, the pre-treatment radiation source may comprise LED or filtered radiation source configured for emitting UV light having high short wavelength content.

In an embodiment, the radiation source may comprise a xenon lamp. Apparatus may have a xenon lamp having quartz fused glass, which provides enhanced short wavelength UV light. A xenon lamp comprising germacil may emit UV light having less low frequency content. The xenon lamp may be positioned a distance from the ink on the substrate, or a gap distance to provide a desired level of energy to the gel ink for pre-treatment. In an embodiment, the xenon lamp may be configured to pulse UV light thereby controlling an amount of irradiance to which the ink is exposed. A frequency of pulsing may be adjusted as needed.

In an embodiment, systems may include a pre-treatment apparatus or system having a radiation source that is configured to expose radiation curable gel ink that has been deposited onto a substrate to radiation for preferential curing of the ink. The pre-treatment apparatus may comprise a radiation source that is configured to emit short wavelength UV light. The gel ink may be exposed to the UV light at a pre-leveling zone, preceding a contact-leveling nip of a contact leveling apparatus. The contact-leveling apparatus may include a pressure or contact member such as a leveling roll, drum or belt. The contact-leveling apparatus may include a backing member, such as a roll, that defines a contact-leveling nip together with the leveling member. Ink may be deposited on a substrate, and the substrate may be transported to the pre-leveling zone for pre-treatment by the radiation source of the pre-treatment apparatus. The ink may be irradiated by short wavelength radiation to preferentially cure the ink thereby allowing both spreading of the ink at the contact-leveling nip, and spreading of the ink with minimal or no offset onto components of the contact-leveling apparatus.

Exemplary embodiments are described herein. It is envisioned, however, that any system that incorporates features of apparatus and systems described herein are encompassed by the scope and spirit of the exemplary embodiments.

DETAILED DESCRIPTION

Figure 1:
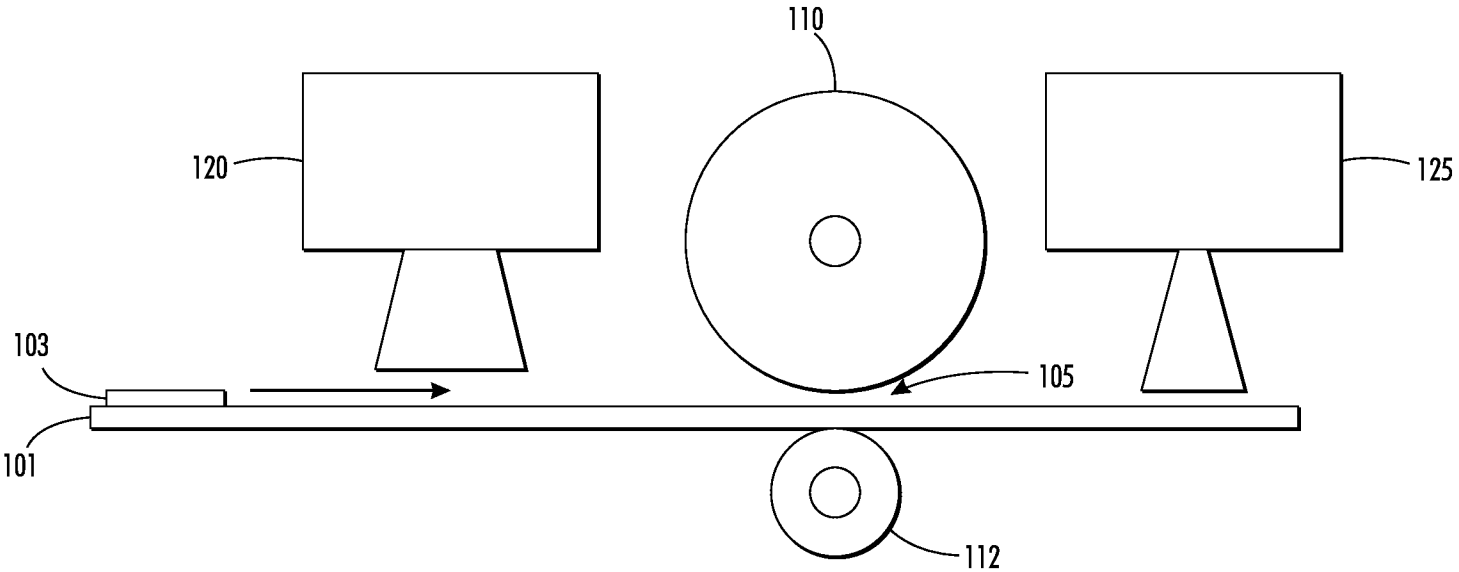
FIG. 1 shows a diagrammatical view of a radiation pre-treatment and contact-leveling system in accordance with an exemplary embodiment.

Exemplary embodiments are intended to cover all alternatives, modifications, and equivalents as may be included within the spirit and scope of the apparatus and systems as described herein.

Reference is made to the drawings to accommodate understanding of methods, apparatus, and systems for short wavelength UV pre-treatment for UV gel ink printing. In the drawings, like reference numerals are used throughout to designate similar or identical elements. The drawings depict various embodiments and data related to embodiments of illustrative methods, apparatus, and systems for radiation curable gel ink printing, including applying a short-wavelength UV treatment to UV gel ink deposited onto a substrate before contact-leveling the ink on the substrate.

Contact-leveling radiation curable gel ink at a leveling nip may mask missing jet(s) in a print head configured for inkjet line image printing, and/or improve gloss uniformity and control. In particular, after radiation curable gel ink, such as UV gel ink, is deposited onto a substrate, the gel ink may be spread or leveled by a leveling apparatus. A leveling apparatus may comprise a contact-leveling member such as a leveling roll, belt, or drum. The leveling roll may define a contact-leveling nip with a backing member, for example, a backing roll. It has been found that contact-leveling radiation curable gel ink can be problematic insofar as ink may offset onto the leveling roll, leading to poor image quality, increased printing system maintenance frequency, and shortened contact-leveling apparatus component life.

Accordingly, after radiation curable gel ink is deposited onto a substrate, the ink may be pre-treated before the ink is spread on the substrate by a leveling apparatus. For example, UV curable gel ink may be deposited onto a substrate to form a line image. Before spreading the ink of the line image by contacting the ink with a leveling member, the ink may be pretreated. For example, the UV curable gel ink may be treated with UV to partially polymerize the ink to avoid offset onto system components while allowing spreading or leveling sufficient to accommodate gloss control and/or uniformity and/or masking missing ink jets. A radiation source configured for emitting UV light may be configured adjacent to a pre-treatment zone, or an area where ink is exposed to radiation before spreading treatment or processing by a leveling apparatus.

It has been found that when pretreating deposited UV curable gel ink with narrow band UV LED having a wavelength of about 395 nm, it is difficult to control the pretreatment so as to avoid offset while accommodating adequate spreading. For example, the longer wavelength UV radiation of the radiation source may penetrate the ink layer to a greater depth than that of a radiation source configured to emit broad spectrum UV of similar total power. In other words, an effect of using such an LED radiation source may be to over-cure an interior of the ink layer when an appropriate dose is administered to render enough cure to the surface of the ink to avoid offset, leading to little or no latitude for the pretreatment and spreading process.

A radiation source that provides short wavelength, e.g., UV radiation may be used to form a skin on a deposited ink layer that will not offset onto a contact leveling member while allowing a bulk of the ink layer to remain deformable and amenable to leveling or spreading. In particular, short wavelength radiation has limited penetration into the ink layer, and effects surface cure preferentially.

While pre-treatment by radiation exposure may be continuous for a pre-treatment period, to avoid heating the ink of a deposited ink layer and minimize diffusion of oxygen into a surface of the ink, a short wavelength pulsed radiation source may be used. Pulsing the short wavelength radiation emitted by the radiation source may enhance an effectiveness of the radiation pretreatment. Further, pulsing the short wavelength radiation may enable enhanced control over energy received by the ink. A frequency and duration of pulsing may be adjusted as necessary. Accordingly, the rheological and surface properties of the ink layer may be changed in situ by way of partial polymerization, thereby allowing for effective contact-leveling.

Suitable short wavelength radiation includes UV radiation having a UVB component in a range of about 280 nm to about 320 nm, and a UVC component in a range of about 280 nm and below. Such UV radiation is more effective for preferentially curing a surface of deposited radiation curable gel ink than, for example, UV radiation having longer wavelengths. Such longer wavelength UV radiation may include a UVA component in a range of about 320 nm to about 390 nm, and a UW component in a range of about 395 nm to about 445 nm. Longer wavelength radiation is suitable for depth curing UV gel ink.

In an embodiment, radiation curable gel ink may be deposited onto a substrate. For example, the gel ink may be deposited as ink lines that form an ink image. The gel ink may then be exposed to radiation in a pre-treatment step. The pre-treatment radiation is short wavelength radiation emitted from a radiation source. An exemplary radiation source includes a radiation source comprising an undoped mercury bulb may be configured to emit UV radiation having enhanced short wave content. The mercury bulb may comprise an envelope made of clear fused quartz. Alternatively, the radiation source may comprise an LED source or a filtered source that emits UV radiation having spectral content below about 300 nm.

The radiation source may be placed near, for example, a pre-leveling zone in a radiation curable gel ink printing system. The pre-leveling zone may precede, in a print process direction, a contact-leveling apparatus that is configured to spread UV gel ink that is deposited onto a substrate such as paper, or other suitable media. The contact-leveling apparatus may include a pressure member or leveling member, such as a roll, drum, or belt. The leveling roll may form a leveling nip with a backing member. The backing member may be a roll, drum, or other suitable backing structure. After the radiation curable gel ink is deposited onto the substrate, the ink may be spread at the contact-leveling apparatus. The leveling roll may be configured to contact the ink, and spread the ink by applying pressure against the backing roll.

To prevent an amount of ink from offsetting to the leveling member, the rheology and surface of the ink is controlled by limited and/or controlled exposure to selected wavelengths of UV in the pre-treatment step in accordance with methods, apparatus and systems of embodiments. For example, the ink is exposed to short wavelength UV radiation to allow partial polymerization of the ink, changing a molecular weight of the ink in situ. Further, an amount of energy to which the ink is exposed may be controlled. For example, a number of photons to which the ink is exposed during pre-treatment may be controlled by using short pulses of UV light at high power. A suitable radiation source may comprise a Xenon lamp, which may accommodate short pulsing of UV light at high power and a predetermined frequency for a predetermined number of pulses. This allows for small exposures, compared with Mercury UV arc lamps, which emit radiation continuously during operation.

FIG. 1 shows a radiation curable gel ink printing system in accordance with an embodiment. In particular, FIG. 1 shows a radiation curable gel ink printing system having a contact-leveling apparatus, and a pre-treatment radiation source for exposing ink deposited onto a substrate to radiation to preferentially cure the ink before spreading the ink at the contact leveling apparatus. A media transport 101 may be configured to transport a substrate 103 having deposited thereon radiation curable gel ink. For example, a gel ink inkjet printhead may be configured to jet ink onto the substrate 103 to form ink lines. The ink lines may form an ink image.

The substrate 103 may be transported to a contact-leveling nip 105 to flatten or spread the ink. Ink may be spread to, e.g., control a gloss level of an image formed by the ink, and/or to mask missing jet(s) that may cause gaps between ink lines.

The leveling nip 105 may be defined by a pressure roll or leveling roll 110 and a backing roll 112. The leveling roll 110 may comprise, for example, an aluminum drum. The leveling roll 110 may be configured to contact the ink deposited on the substrate 103 to spread the ink. In an alternative embodiment, the leveling member may be in the form of a belt, such as an endless belt.

In an embodiment of apparatus and systems as shown in FIG. 1, a first radiation source 120 may be arranged adjacent to the media transport 101. The radiation source 120 may be configured to emit radiation such as UV radiation. The radiation source 120 may emit UV light, for example, to expose ink on a substrate 103 as the substrate 103 is transported through a pre-leveling zone, which precedes the leveling nip 105.

The radiation source 120 may be configured and controlled to pre-treat the ink on the substrate 103 at the pre-leveling zone to accommodate effective spreading of the ink at the contact-leveling nip 105. In particular, the radiation source 120 may be configured to emit UV radiation having short wavelengths. For example, the radiation source 120 may be configured to emit UV radiation having UVB in a range of about 280 nm to about 320 nm, and UVC in a range of about 280 nm and below. The ink on the substrate 103 may be exposed to UV radiation emitted by the radiation source 120 so as to preferentially cure a surface of the ink while curing the underlayers of the ink to a lesser extent, thereby allowing the image to be spread without offsetting to the spreading roller. In an embodiment, the ink may be exposed to continuous UV emission. The exposure may last for a period of time, and emission may be continuous during that period. In an alternative embodiment, an amount of photons to which the ink is exposed may be controlled by pulsing the radiation source 120. A gap distance between the ink and the radiation source 120 may also be adjusted for controlling an irradiance of emitted, e.g., UV light.

Multiple layer images may require a first dose of UV radiation of an appropriate energy level. A multilayer image, depending on the substrate, may require some radiation to stabilize the ink layers before moving to the spreader or contact-leveling apparatus. It may be appreciated that a thick image may need some long wavelength UV radiation at low power to pin the image to the substrate (this process is commonly known as "pinning" to those practiced in the art) prior to exposure to pre-treatment radiation from the short wavelength UV radiation source 120 in preparation for spreading. A UV source configured to emit long wavelength radiation at low power for pinning (not shown) may be arranged upstream of the leveling nip 105. The UV source (not shown) used for pinning may be arranged upstream of the short wavelength UV radiation source 120, for example.

After the radiation source 120 emits UV radiation to pre-treat the ink on the substrate 103 by exposing the image to short wavelength radiation for preferential curing, the substrate 103 may be transported to the leveling nip 105 for processing. The leveling roll 110 may be configured to contact the pre-treated ink, spreading the ink with minimal or no offset of the ink onto the surface of the leveling roll 110. After the ink on the substrate 103 has been spread by the leveling apparatus, the ink may be exposed to radiation at a second radiation source 125. The second radiation source may be configured, for example, to emit UV radiation having a longer wavelength that penetrates into the ink to cure the ink.

Figure 2A:
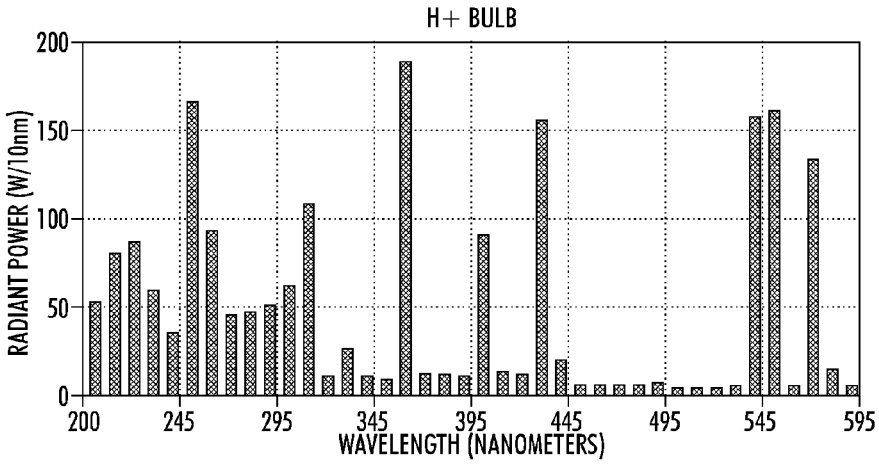
FIG. 2A shows a radiation source emission spectrum showing enhanced short wavelength content.

A radiation source such as radiation source 120 may comprise a mercury lamp, for example. To achieve effective enhanced short wavelength emission, the radiation source 120 may include an undoped mercury bulb having a clear, fused quartz envelope. As shown in FIG. 2A, an undoped mercury lamp accommodates enhanced short wave UV content in the emission. In particular, FIG. 2A shows a typical undoped mercury emission spectrum having enhanced short wave UV content.

Figure 2B:
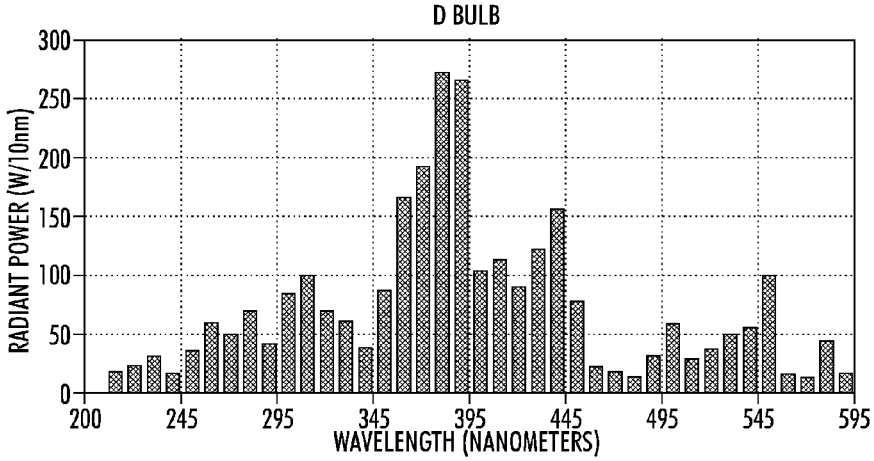
FIG. 2B shows a radiation source emission spectrum showing long wavelength content that is higher than that shown in FIG. 2A.

FIG. 2B shows a typical emission spectrum for an iron-doped mercury lamp. Specifically, FIG. 2B shows a much higher UVA content than an undoped mercury lamp. FIG. 2B shows that the emission of the doped mercury lamp exhibits a much higher UVA content, e.g., in a range of about 320 nm to about 390 nm.

Figure 3:
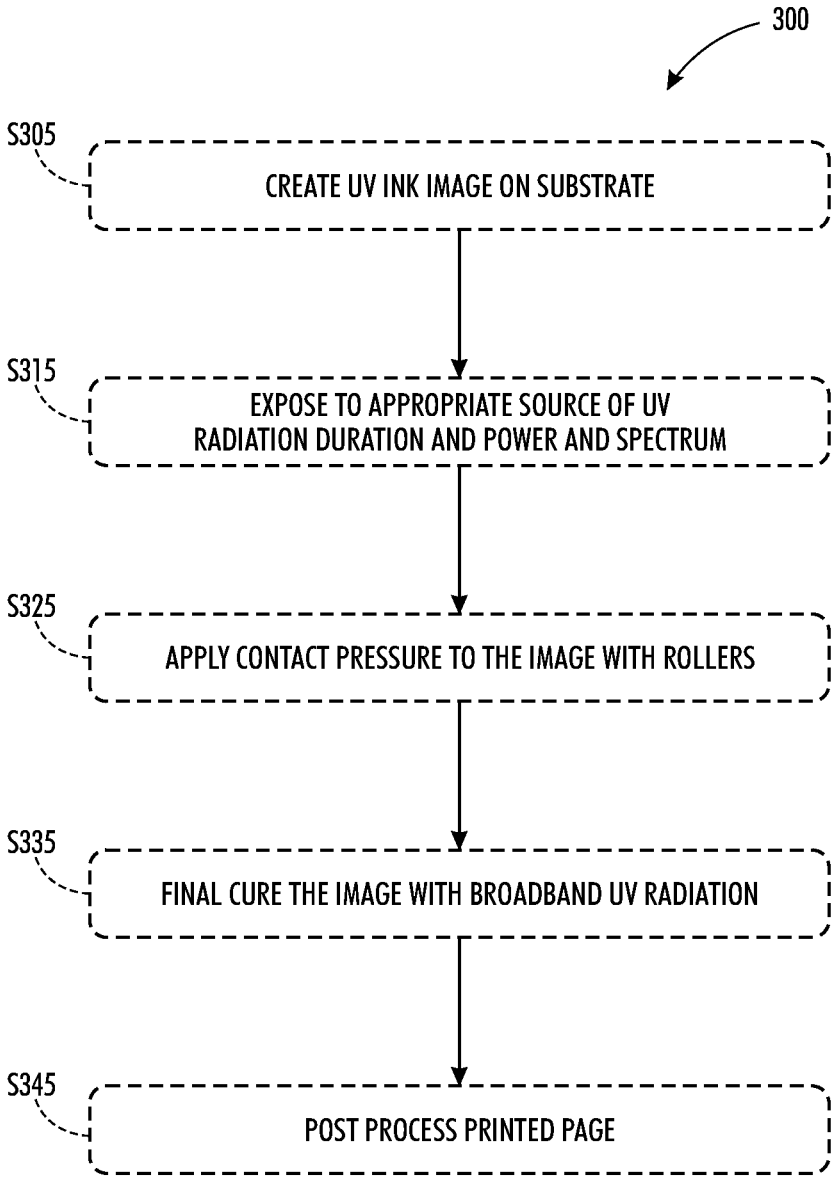
FIG. 3 shows a UV gel ink contact-leveling process including UV pretreatment in accordance with an exemplary embodiment.

FIG. 3 shows a radiation curable gel ink printing method 300 with UV pre-treatment before ink spreading in accordance with an embodiment. In particular, the embodiment shown in FIG. 3 includes creating a radiation curable gel ink image on a substrate at step S305. For example, an inkjet print head may be configured to deposit ink lines onto a substrate to form an image.

At S315, the ink image may be exposed to radiation such as UV light. A duration, power, and spectrum may be controlled to achieve pre-treatment that is effective for preventing offset of the ink onto a pressure member of a contact-leveling apparatus while allowing spreading of the ink. At S325, the pre-treated ink may be contacted with a pressure member, such as a leveling roll, to spread and flatten the ink. This allows for gloss control and masking of missing jets. Pre-treating the ink at S315 by preferentially curing a portion of the ink to alter the rheological properties of the ink enables the ink to be spread with minimal or no offset of the ink onto components of the contact-leveling apparatus.

At S335, after the substrate exits the contact-leveling nip, a second radiation treatment may be applied to the spread or leveled ink. For example, radiation may be applied to the ink to final cure the ink image with broadband UV radiation. The pre-treatment radiation applied at S315 may reduce the energy required for final curing at S335. The final cured image may be post-processed at S345. This may include, for example, stacking and registering the print including the leveled cured image.

Figure 4:
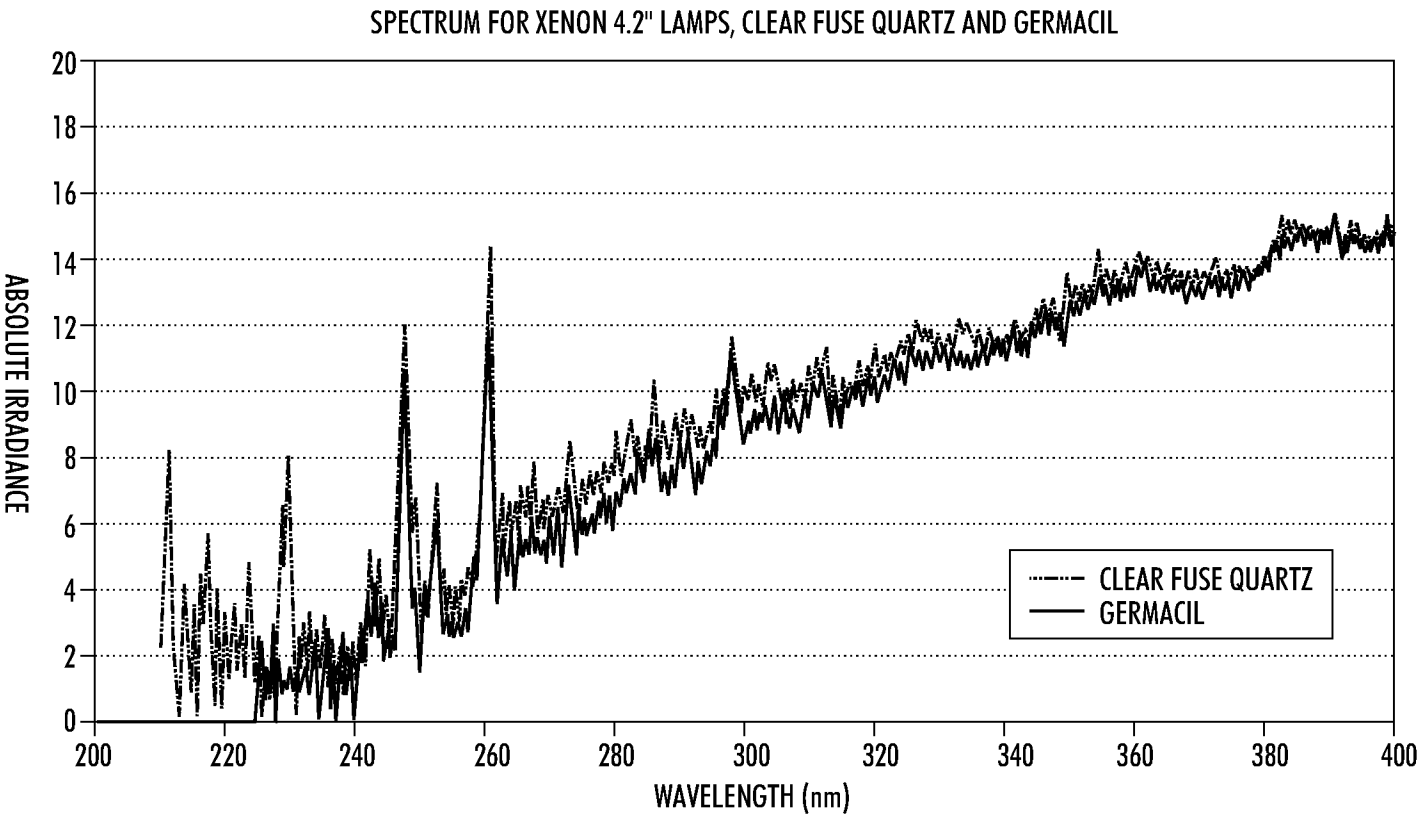
FIG. 4 shows a first Xenon bulb spectrum showing a higher short wave content than a second Xenon bulb spectrum.

In an embodiment, the radiation configured for pre-treatment may comprise a mercury lamp. In another embodiment, the radiation source configured for pre-treating radiation curable gel ink on a substrate before the ink is spread at a contact-leveling nip of a contact-leveling apparatus may comprise a Xenon lamp. In addition to controlling wavelengths of radiation emission, the energy of radiation emission may be controlled by short-pulsing UV light. A Xenon lamp is exemplary of a radiation source suitable for pulsed, high power radiation output. FIG. 4 shows two spectra of typical Xenon bulbs. The bulbs used to produce the depicted data are Xenon 4.2 inch lamps. The spectrum having higher short wavelength content corresponds to the Xenon lamp that uses a clear, fused quartz glass envelope. The other spectrum having less low frequency content was produced by a Xenon lamp including Germacil.

Figure 5:
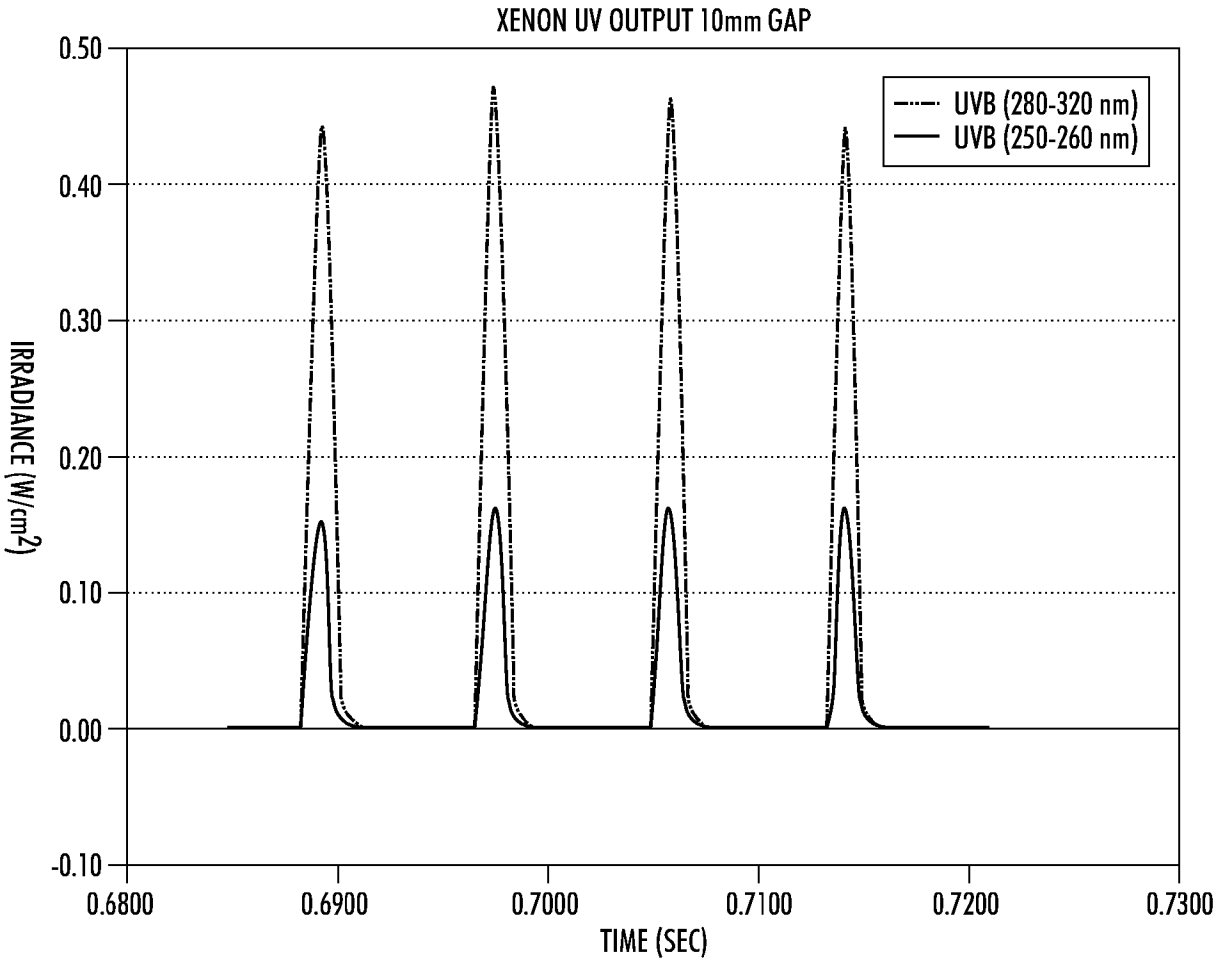
FIG. 5 shows Xenon pulsed source irradiance showing integrated UVB and UVC components of UV output.

FIG. 5 shows Xenon pulsed source irradiance relating to integrated UVB and UVC components of the emitted UV radiation. The radiation source used to produce the results shown in FIG. 5 included a Xenon lamp spaced 10 mm away from ink on a substrate. As a gap distance decreases, a pulse height or amount of irradiance decreases. Parameters that may be altered for effective pre-treatment for contact-leveling gel ink include emitted radiation pulse frequency, radiation source gap distance, radiation emission duration or pulse duration, and wavelength as discussed above.

Figure 6A:
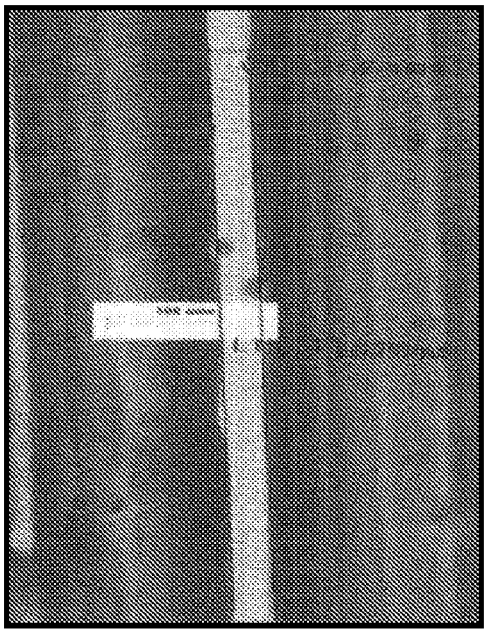
FIG. 6A shows a radiation curable gel ink line image before spreading and after UV pretreatment with a pulsed UV source.

FIG. 6A shows the effects of UV pre-treatment on positive and negative gel ink lines that form an image. FIG. 6A shows a radiation curable gel ink image before spreading. The centrally located negative vertical line is the result of a missing jet in the printhead. Before spreading the ink, the ink was pre-treated with short wavelength, pulsed UV light.

Figure 6B:
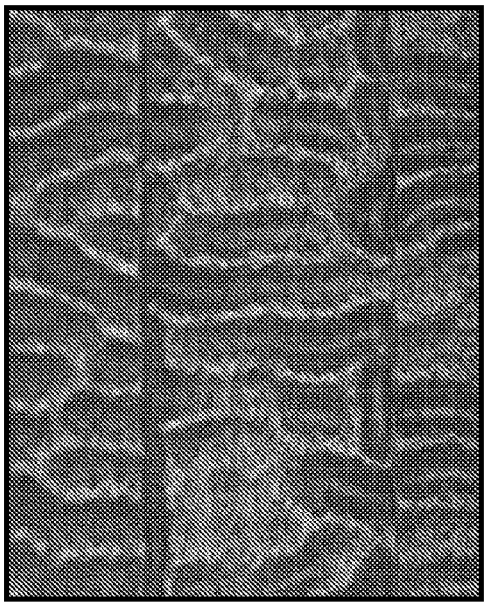
FIG. 6B shows a radiation curable gel ink line image after UV pretreatment, and after spreading.

As shown in FIG. 6B, the pretreatment enabled spreading of the ink by contact-leveling with minimal or no offset of the gel ink onto the pressure member or leveling member of the contact-leveling apparatus. The effect of the missing jet on the radiation curable gel ink image has been masked by the spreading process.

Figure 7A:
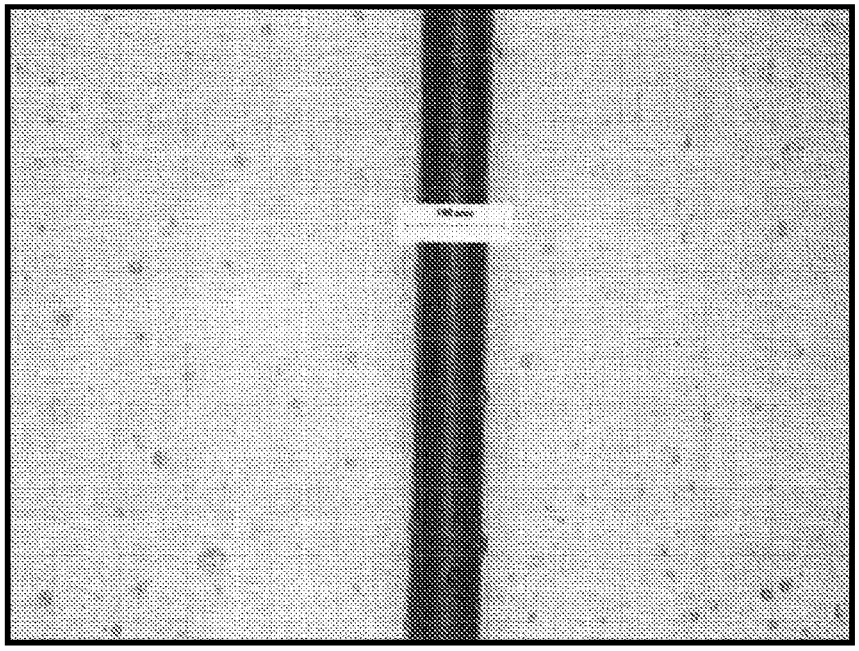
FIG. 7A shows a radiation curable gel ink line deposited on a substrate before radiation source pretreatment, and before contact leveling.
Figure 7B:
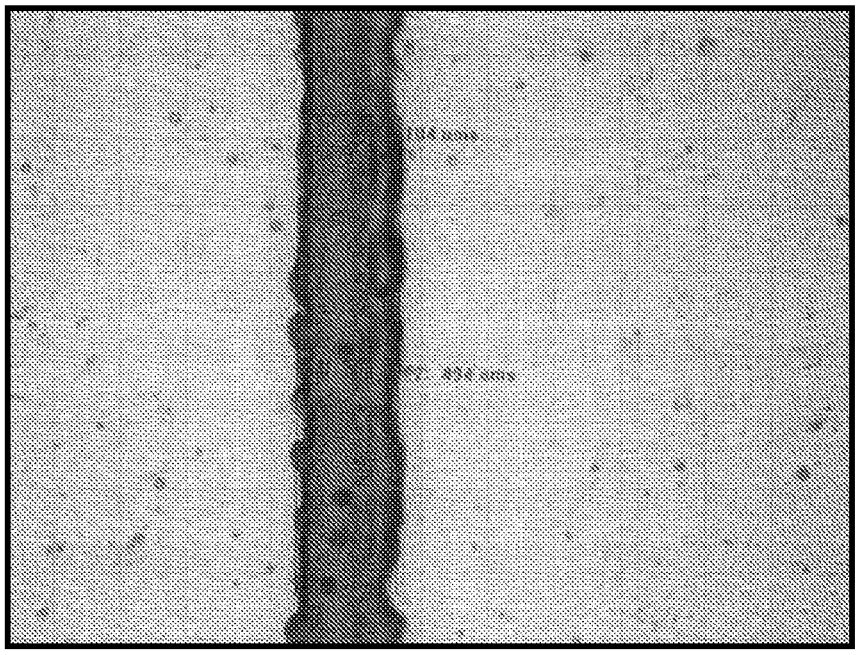
FIG. 7B shows a radiation curable gel ink line deposited on a substrate, pretreated with radiation, and spread at a contact-leveling nip.

FIG. 7A shows a line of radiation curable gel ink that has been deposited on a paper substrate. The ink shown in FIG. 7A has not been exposed to curing radiation, such as UV light. Further, the ink shown in FIG. 7A has not be spread by a contact-leveling apparatus. By pulsing UV light having a high short wavelength content, a low, controlled level of energy may be applied to the ink for preferentially curing an outer surface layer of the ink, while enabling an inner layer of the ink to remain soft and susceptible to spreading. Accordingly, the outer surface layer of the ink will not offset onto a contact-leveling member such as a pressure roll or leveling roll, while an underlying ink layer is allowed to spread. FIG. 7B shows an ink line after pre-treatment by UV light, and after spreading by contact-leveling. The ink did not offset to the leveling member of the contact-leveling apparatus during spreading.

Figure 8:
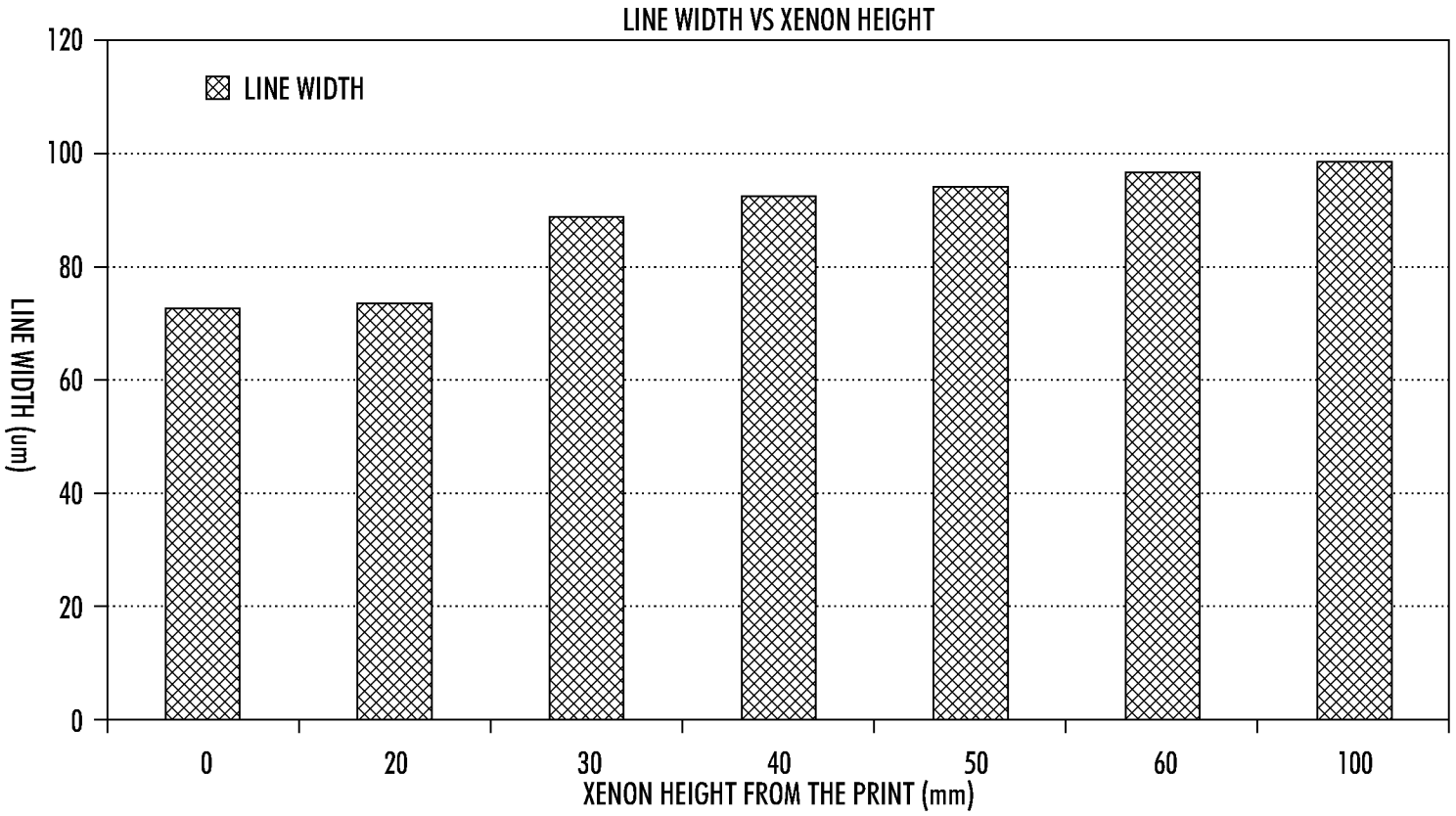
FIG. 8 shows the effects UV gel ink lines deposited on a substrate after being subject to UV pretreatment and contact-leveling.

As discussed above, an amount of energy delivered to the ink by radiation may be controlled to affect the ink as desired. One method for controlling an energy level of applied radiation from a radiation source is to adjust a distance between the radiation source and ink deposited on a substrate. This distance, e.g., a gap distance, may be adjusted to increase or decrease an amount of energy delivered to the ink when exposing the ink to UV light. For example, an amount of energy applied to the ink increases as a gap distance decreases. FIG. 8 shows a graph of gel ink line width on a paper substrate versus a height or gap distance of a radiation source with respect to a substrate. In particular, the radiation source used was a Xenon lamp. FIG. 8 shows that as a gap distance between the Xenon radiation source and the substrate was decreased for UV pre-treatment, a line width or degree of spreading decreased.

It will be appreciated that various of the above-disclosed and other features and functions, or alternatives thereof, may be desirably combined into many other different systems or applications. Also, various presently unforeseen or unanticipated alternatives, modifications, variations or improvements therein may be subsequently made by those skilled in the art.

What is claimed is:

1. A radiation curable gel ink printing method, comprising:

exposing radiation curable gel ink on a substrate to pre-treatment radiation from a first radiation source to partially cure the radiation curable gel ink after the radiation curable gel ink is deposited onto the substrate;

spreading the partially cured radiation curable gel ink by contacting the radiation curable gel ink with a leveling unit; and exposing the radiation curable gel ink to final curing radiation from a second radiation source after the spreading to substantially full cure the radiation curable gel ink downstream of the leveling unit in a process direction.

2. The method of claim 1, further comprising:

depositing the radiation curable gel ink on the substrate using an inkjet printhead.

3. The method of claim 1, the exposing the radiation curable gel ink to the pre-treatment radiation comprising:

irradiating the radiation curable gel ink with UV light emitted by the first radiation source.

4. The method of claim 3, the first radiation source being a mercury lamp.

5. The method of claim 3, the first radiation source being an LED.

6. The method of claim 3, the first radiation source being a Xenon lamp.

7. The method of claim 4, the exposing the radiation curable ink to the pre-treatment radiation occurring during a pre-treatment period, the irradiating being continuous during the pre-treatment period.

8. The method of claim 6, the exposing the radiation curable ink to the pre-treatment radiation occurring during a pre-treatment period, the irradiating being pulsed during the pre-treatment period.

9. A radiation curable gel ink printing apparatus, comprising:

a first radiation source that is configured to partially cure a radiation curable gel ink deposited on a substrate;

a contact-leveling unit that is positioned downstream of the first radiation source in a process direction and is configured to spread the partially cured radiation curable gel ink; and a second radiation source that is positioned downstream of the contact-leveling unit in the process direction and is configured to final cure the radiation curable gel ink on the substrate after the radiation curable gel ink is processed by the contact-leveling unit to fully cure the radiation curable gel ink, the radiation curable gel ink having an inner layer that contacts an ink-bearing side of the substrate and an outer layer, the inner layer interposing the outer layer and the ink-bearing side of the substrate, the partial cure curing the outer layer while not curing the inner layer, the final cure curing the outer layer and the inner layer to the substrate.

10. The apparatus of claim 9, the first radiation source being a mercury lamp.

11. The apparatus of claim 9, the first radiation source comprising being a xenon lamp.

12. The apparatus of claim 11, the xenon lamp including a clear, fused quartz glass envelope.

13. The apparatus of claim 10, the first radiation source being configured to emit UV light continuously.

14. The apparatus of claim 11, the first radiation source being configured to emit pulsed UV light.

15. The apparatus of claim 9, the first radiation source being configured to emit UV light comprising a UVB component having a wavelength in a range of about 280 nanometers to about 320 nanometers, and UVC having a wavelength equal to or less than about 280 nanometers.

16. A radiation curable gel ink printing system, comprising:

a pre-treatment unit for pre-treating radiation curable gel ink deposited on a substrate, the pre-treatment unit comprising a radiation source for emitting short wavelength UV light for partially curing an outer layer of the radiation curable gel ink while leaving an inner layer of the radiation curable gel ink in contact with the substrate uncured;

a contact-leveling unit that is positioned downstream of the pre-treatment unit in a process direction for spreading the pre-treated radiation curable gel ink on the substrate, the contact-leveling unit comprising a leveling member that contacts the pre-treated radiation curable gel ink to spread the pre-treated radiation curable gel ink to spread the pre-treated radiation curable gel ink with substantially no offset of the pre-treated radiation curable gel ink onto the leveling member; and a final curing unit that is positioned downstream of the contact-leveling unit in the process direction for final curing the radiation curable gel ink on the substrate after the radiation curable gel ink is processed by the contact-leveling unit to fully cure the outer layer and the inner layer of the radiation curable gel ink on the substrate.

* * * * *